US007364285B2

(12) United States Patent
Murad et al.

(10) Patent No.: US 7,364,285 B2
(45) Date of Patent: Apr. 29, 2008

(54) PRESSURE DAMPING INK FILTER

(75) Inventors: George Murad, Bartlett, IL (US); Frank Eremity, Streamwood, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 346 days.

(21) Appl. No.: 11/232,297

(22) Filed: Sep. 21, 2005

(65) Prior Publication Data

US 2007/0064069 A1 Mar. 22, 2007

(51) Int. Cl.
*B41J 2/17* (2006.01)

(52) U.S. Cl. ..... 347/94; 347/93

(58) Field of Classification Search ..... 347/85, 347/93, 94

See application file for complete search history.

(56) References Cited

U.S. PATENT DOCUMENTS 4,347,524 A * 8/1982 Engel et al. ..... 347/94
5,030,973 A * 7/1991 Nonoyama et al. ..... 347/93
6,120,140 A * 9/2000 Hirosawa et al. ..... 347/93
6,158,855 A * 12/2000 Saikawa ..... 347/93
6,364,457 B1 4/2002 Colechhi et al.
7,063,414 B2 * 6/2006 Harakawa ..... 347/93
7,182,449 B2 * 2/2007 Inoue ..... 347/93

FOREIGN PATENT DOCUMENTS

JP 61188160 8/1986
JP 61213164 9/1986

OTHER PUBLICATIONS

International Search Report and Written Opinion for PCT/EP2006/009049 mailed Jan. 16, 2007.

* cited by examiner

*Primary Examiner*—Anh T. N. Vo
(74) *Attorney, Agent, or Firm*—McAndrews, Held & Malloy, Ltd.

(57) ABSTRACT

Embodiments of the present invention relate to a pressure damping ink filter for use with an ink jet printer. The pressure damping ink filter includes at least one flow control member and a filter. The flow control member, in combination with any pressure damping provided by the thickness of the filter medium and the ink volume capacity of the filter housing, may substantially reduce, if not eliminate, pressure fluctuations in the ink stream that are generated by a high frequency electric pump. The flow control member may be a fixed or variable input restrictor and a fixed or variable output restrictor. The input restrictor and/or output restrictor may also be located inside or outside of the filter housing. Further, the input and output restrictors may be molded as part of the filter housing or the filter itself.

19 Claims, 4 Drawing Sheets

PRESSURE DAMPING INK FILTER

BACKGROUND OF THE INVENTION

Embodiments of the present invention relate to printing, and particularly to a pressure damping ink filter for use in a continuous ink jet printer.

Continuous ink jet printers are well known in the field of industrial coding and marking, and are widely used for printing information, such as expiry dates, on various types of substrates passing by the printer on production lines. Ink jet printing allows ink to be deposited or printed at predetermined locations on a substrate so as to create desired images, shapes, forms, or characters, without requiring physical contact between the printing device and the substrate.

Conventional ink jet printers may include an ink source, an electric fluid pump, an orifice or orifices (nozzles), a charging tunnel, and deflection electrodes. The ink may be pressurized by the electric fluid pump, which draws the ink from the ink source and pushes the ink through the nozzle. The ink droplets may then be discharged from the nozzle in the form of a filament, which subsequently may break up into a droplet stream. The stream of ink passing through the nozzle may also be broken up into a regular stream of uniform ink drops by an oscillating piezoelectric element. The stream of ink drops may then pass through a charging field, such as that generated by one or more charged electrodes, wherein the individual drops of ink may be charged to selected voltages. The charged droplets may then pass through a transverse electric field, or deflection field, created in the space between a pair of deflection electrodes. Each charged ink droplet may then be deflected by an amount that corresponds to the degree of its respective charge, which may then allow the droplet to be projected at its intended location on the substrate so as to assist in forming the desired image. If the ink droplet is uncharged, it may pass through the deflection electrodes without deflection. Uncharged or slightly charged droplets may be collected in a catcher and returned to the ink source for reuse.

The quality of printing by an ink jet printer is dictated by several factors, including ink pressure. Fluctuation in ink pressure may cause droplets of ink that have been discharged through the nozzle to shift in position as the droplets pass through the charging field. A shift in position in the charging field may result in the ink droplets receiving an improper charge, i.e. an insufficient or excessive charge. The improperly charged ink droplets may then be misdirected by the deflection electrodes, thereby causing the ink to be deposited at an unintended location on either the substrate, which may result in a bad image formation, or on print-head components, which may eventually cause a device failure, such as a high voltage, no signal, or phasing fault.

One common problem of conventional ink jet printers is that the electrical fluid pumps that are used to pressurize the ink stream may generate high frequency pulses, i.e. pressure surges. To alleviate these pressure fluctuations, some ink jet printers utilize a physically large filter medium and accumulators that are housed in a large container, or filter housing. The larger sizes of these systems require that the system use a high volume of ink. The increased size of the filter medium and volume of ink may minimize the effect of pressure fluctuations from the pump. However, the relatively large size of the filter medium and volume of ink required may reduce the effectiveness of these systems, and may also increase operating and construction costs. Further, the large ink volume in these systems increases the chances that a greater portion of ink will go unused before its period of usefulness expires, in which case larger volumes of unused ink may be wasted.

Other pressure damper devices that attempt to reduce or eliminate ink pressure fluctuations in ink printers include a combination of diaphragms and restrictors. Such pressure damper devices may contain moving parts, such as springs and valves. However, the moving parts of such pressure damper devices may be damaged and/or fail as their components come in contact with the ink or other fluids. Further, over a period of time, these moving parts may also degrade, which may result in a reduction in the pressure damper device's ability to effectively maintain the desired pre-set operating ink pressure. These pressure damper devices are also often relatively large in size and costly.

Thus, a need exits for a system of damping ink pressure fluctuations for use in ink jet printing. Overall, a need exists for an efficient and cost-effective system for damping pressure fluctuations in the ink stream of ink jet printers.

BRIEF SUMMARY OF THE INVENTION

Embodiments of the present invention relate to a pressure damping ink filter for use with an ink jet printer. Ink from an ink system, such as an ink cartridge, is drawn into the input portion of an electric pump. The ink is then pressurized before exiting through the output portion of the pump and on towards the pressure damping ink filter. The pressure damping ink filter may include a filter medium positioned in a filter housing and at least one flow control member. The filter medium may remove undesirable debris and/or contaminants from the ink. The flow control member, in combination with any pressure damping provided by the thickness of the filter medium and the ink volume capacity of the filter housing, may substantially reduce, if not eliminate, pressure fluctuations that are generated by the high frequency electric pump. The flow control member, such as fixed or variable input and output restrictors, may be located inside and/or outside the filter housing. Further, the flow control member may be molded as part of the filter housing and/or part of the filter medium itself.

As the ink exits the pressure damping ink filter, a pressure transducer may monitor the pressure of the ink that is being supplied to the nozzle. Because a printer may be calibrated to function with a specific preset level of ink pressure, the pressure transducer may attempt to maintain or restore the preset pressure level of the ink by signaling to the pump to change its speed. Supplying the nozzle with ink that is within the preset pressure level may improve the chances that the selected stream of ink droplets passing through the charging field will be fully charged, and therefore, guided to land at the intended location on the substrate.

The foregoing summary, as well as the following detailed description of the preferred embodiments of the present invention, will be better understood when read in conjunction with the appended drawings. For the purpose of illustrating the preferred embodiments of the present invention, the drawings depict embodiments that are presently preferred. It should be understood, however, that the present invention is not limited to the arrangements and instrumentality shown in the attached drawings.

DETAILED DESCRIPTION OF THE INVENTION

Figure 1:
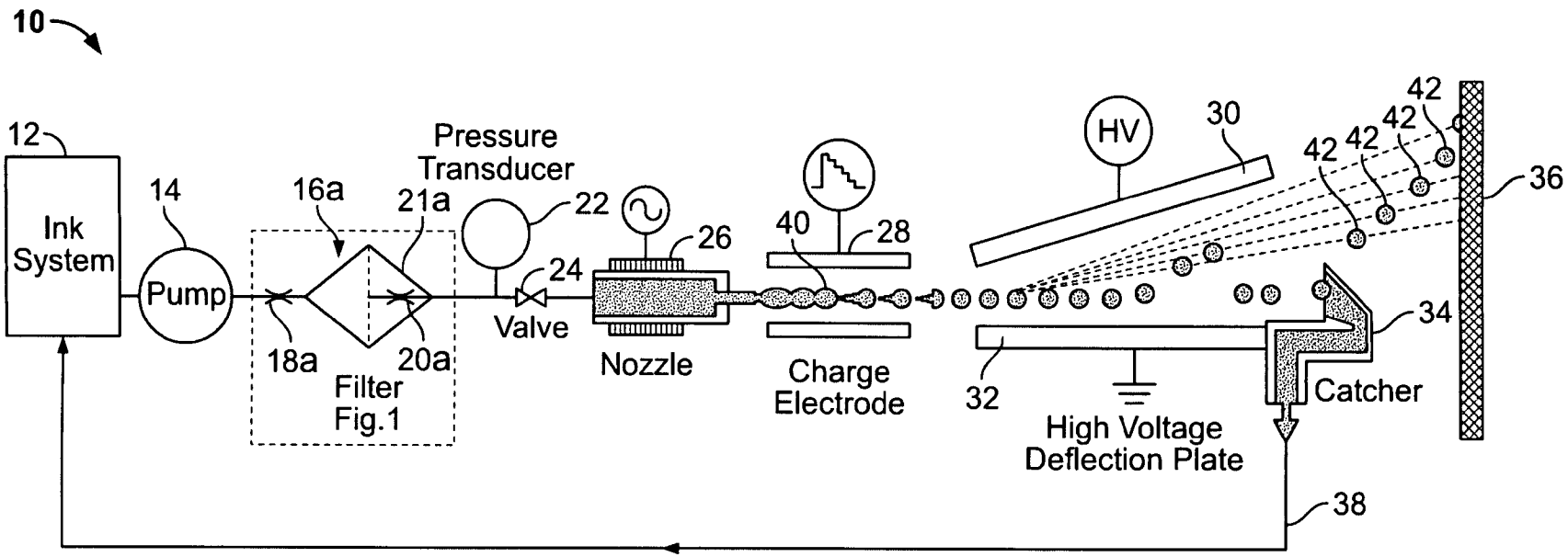
FIG. 1 illustrates a schematic diagram of a continuous ink jet printer having a pressure damping ink filter that includes a fixed input restrictor located outside the filter housing and a fixed output restrictor located inside the filter housing according to an embodiment of the present invention.

FIG. 1 illustrates a continuous ink jet printer 10 having a pressure damping ink filter 16 according to an embodiment of the present invention. As shown, ink from an ink system 12, such as an ink cartridge, is drawn into the input portion of a pump 14, such as an electrical gear pump. Once inside the pump 14, the ink may be pressurized before exiting through the output of the pump 14.

After exiting the output of the pump 14, the ink may pass onto the pressure damping ink filter 16*a*. The pressure damping ink filter 16*a* may include at least one flow control member, such as an input restrictor 18*a* or an output restrictor 20*a*, and a filter housing 21*a*. The filter housing 21*a* may house a filter medium that may remove undesirable debris and/or contaminants from the ink.

The flow control member, such as a variable or fixed restrictor, may restrict or regulate the flow rate of ink that passes into, or out of, the filter housing 21*a*. By controlling the flow rate of the ink, the flow control member may, in combination with any pressure damping provided by the configurations of the filter medium (including the thickness of the filter medium) and the ink volume capacity of the filter housing 21*a*, assist in substantially reducing, if not eliminating, pressure fluctuations that are generated by a high frequency electric pump 14. In accordance with one embodiment of the present invention, the flow control member may include, but is not limited to, a fixed input restrictor 18*a* and a fixed output restrictor 20*a*, as shown in FIG. 1. The size, configuration, and/or type of flow control member may depend on various factors, including, but not limited to, the viscosity of the ink or fluids, the application, whether the flow control member is located inside or outside the filter housing, and the location of the ink flow path, as discussed in more detail hereinafter.

The pressure damping ink filter 16*a* shown in FIG. 1 includes the fixed input restrictor 18*a* located outside the filter housing 21*a* and the fixed output restrictor 20*a* located inside the filter housing 21*a*. In such an embodiment, the input restrictor 18*a* may be a narrow tube or conduit that may be operably connected to the bottom of the filter housing 21*a*, such as through the use of an adhesive, clasp, threaded connector, ultrasonic weld, or interference fitting, among others. For example purposes, in one embodiment, the input restrictor 18*a* may be an approximately 24 inch long tubing having an inner diameter of about 1/32 inch. However, as previously mentioned, the selected size, shape, and/or configuration of the input and output restrictors 18*a*, 20*a* may depend on various factors, including, but not limited to, the viscosity of the ink or fluids.

Figure 2:
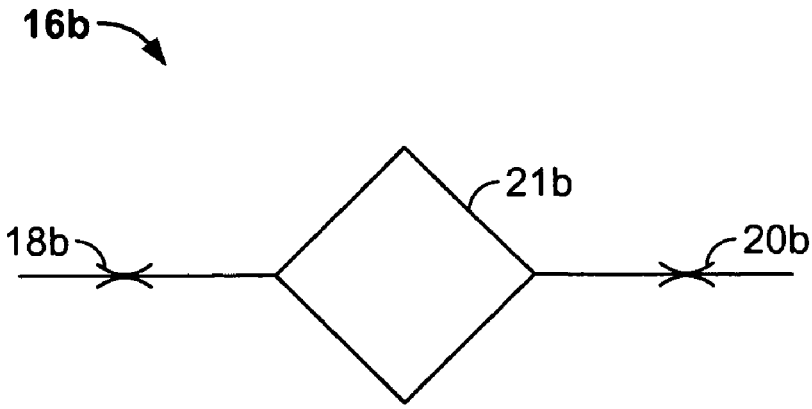
FIG. 2 illustrates a pressure damping ink filter that includes both a fixed input restrictor and a fixed output restrictor located outside the filter housing according to an embodiment of the present invention.
Figure 3:
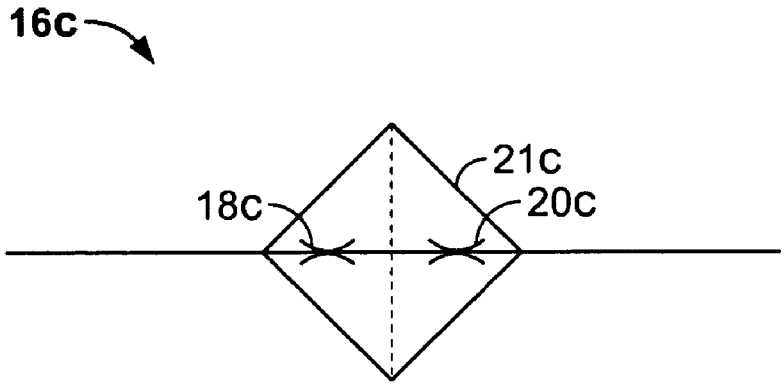
FIG. 3 illustrates a pressure damping ink filter that includes both a fixed input restrictor and a fixed output restrictor located inside the filter housing according to an embodiment of the present invention.
Figure 4:
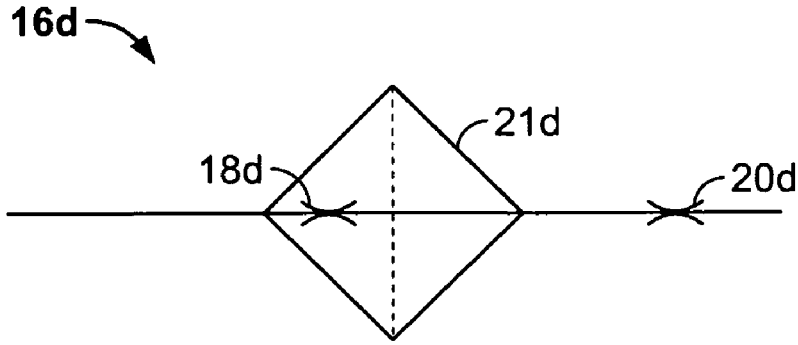
FIG. 4 illustrates a pressure damping ink filter that includes a fixed input restrictor located inside the filter housing and a fixed output restrictor located outside the filter housing according to an embodiment of the present invention.

Other arrangements of input and output restrictors 18*a*, 20*a* are shown in FIGS. 2-4. FIG. 2 illustrates a pressure damping ink filter 16*b* having fixed input and output restrictors 18*b*, 20*b* located outside the filter housing 21*b*. FIG. 3 illustrates a pressure damping ink filter 16*c* having fixed input and output restrictors 18*c*, 20*c* located inside the filter housing 21*c*. FIG. 4 illustrates a pressure damping ink filter 16*c* having a fixed input restrictor 18*c* located inside the filter housing 21*c* and a fixed output restrictor 20*c* located outside the filter housing 21*c*.

Figure 5:
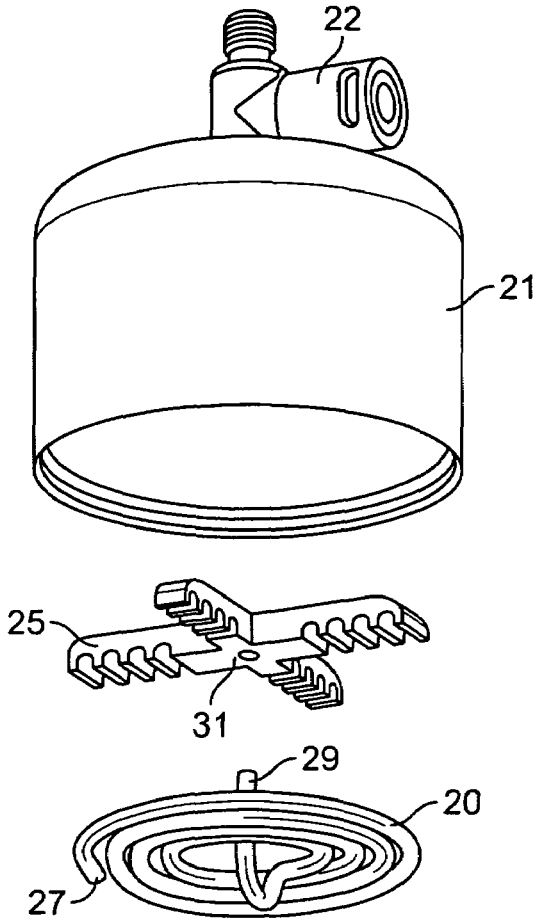
FIG. 5 illustrates an exploded view of a portion of a pressure damping ink filter having an output restrictor positioned inside the filter housing according to an embodiment of the present invention.

FIG. 5 illustrates an exploded view of a portion of the pressure damping ink filter 16 having the output restrictor 20 positioned inside the filter housing 21 according to an embodiment of the present invention. In such an embodiment, the input restrictor 18 (not shown) may be positioned inside or outside of the filter housing 21. The output restrictor 20 may be constructed or formed from tubing or conduit that is similar or identical to that of the input restrictor 18. For placement purposes, including the size constraints of the inner portion of the housing 21 and/or the location of the ink flow path in relation to the location of the inlet 27 of the output restrictor 20, an output restrictor 20 that is located within the filter housing 21 may have a coiled configuration, as shown in FIG. 5.

By way of example, in one embodiment, a clasp 25 may assist in securing the position and/or coiled configuration of the output restrictor 20. The clasp 25 may also include an orifice 31 that is configured to receive, and possibly secure, at least a portion of the outlet 29 section of the output restrictor 20. Optionally, the output restrictor 20 may instead be secured in a variety of ways, including, but not limited to, through the use of hangers, prongs, adhesives, ties, and interference fittings, among others, as will be appreciated by those skilled in the art. Further, the type of clasp 25 or connector, if any, used to position or secure a flow control member inside or outside of the filter housing 21 may depend on the type, size, and shape of the flow control member.

Figure 6:
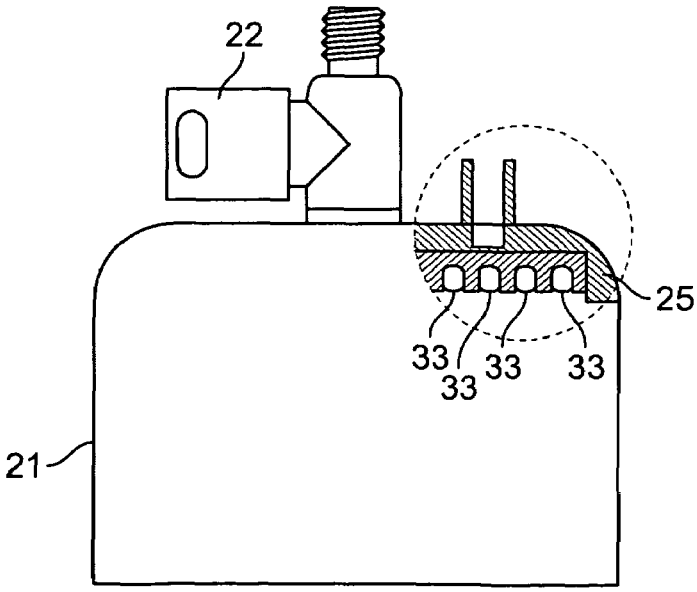
FIG. 6 illustrates a partial cross sectional view of a portion of a pressure damping ink filter having an output restrictor secured inside the filter housing according to an embodiment of the present invention.

FIG. 6 illustrates a partial cross sectional view of a portion of a pressure damping ink filter 16 having the output restrictor 20 secured inside the filter housing 21 according to an embodiment of the present invention. As shown, the clasp 25 may include cavities 33 that are sized and shaped to receive and hold portions of the output restrictor 20. As shown, cavities 33 may have semi-circular shapes that may be large enough to receive insertion of a portion of the output restrictor 20, while also configured to maintain the location and/or configuration of the output restrictor 20. The clasp 25 may also hold the output restrictor 20 inside the upper portion of the filter housing 21.

Figure 7:
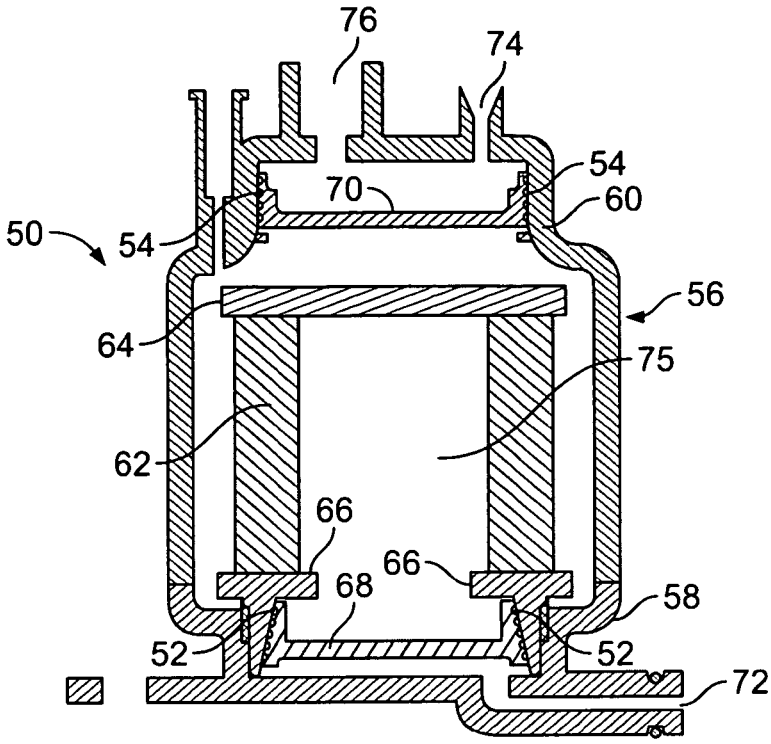
FIG. 7 illustrates a cross sectional view of a pressure damping ink filter having molded input and output restrictors located inside a filter housing according to an embodiment of the present invention.

FIG. 7 illustrates a cross sectional view of a pressure damping ink filter 50 having a molded input restrictor 52 and an output restrictor 54 located inside a filter housing 56 according to an embodiment of the present invention. While the input and output restrictors 52, 54 are both shown in FIG. 7 as being located inside the filter housing 62, as previously discussed, in alternative embodiments, the input and output restrictors 52, 54 may or may not both be located inside the filter housing 62.

The filter housing 56 illustrated in FIG. 7 includes an inner portion 75 that may be configured to receive the insertion and placement of a filter medium 62. The filter housing 56 may also be sized to hold a predetermined amount of ink, such as, but not limited to, 80 ml of ink. The filter housing 56 may include a lower portion 58 and an upper portion 60. Ink may be pumped into the filter housing 56 through an inlet 72 in the lower portion 58 of the filter housing 56. Once inside the filter housing 56, the ink may proceed onto the input restrictor 52.

Figure 8:
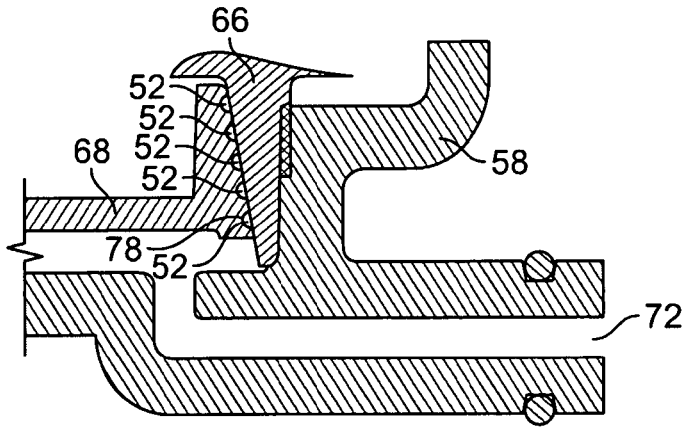
FIG. 8 illustrates a cross sectional view of a molded input restrictor according to an embodiment of the present invention.

FIG. 8 illustrates a cross sectional view of a molded input restrictor 52 according to an embodiment of the present invention. The input restrictor 52 may be molded into the lower insert 68. Additionally, as shown in FIG. 8, the input restrictor 52 may also be formed by the placement of a contoured outer side portion 78 of the lower insert 68 against a first adjacent surface, such as the filter base 66, or the inner walls of the lower portion 58 of the filter housing 56. The contoured outer side portion 78 may be formed by the use of ribs, ridges, or grooves in the lower insert 68. The abutment of the contoured outer side surface 78 against the first adjacent surface, such as the filter base 66, may allow for the formation of an input restrictor 52 that may provide a narrow conduit through which ink may flow from the inlet 72 of the filter housing 56 and onto the filter medium 62. For example, in the embodiment illustrated in FIG. 8, the contoured outer side portion 78 of the lower insert 68 may have a spiral grooved configuration. A spiral grooved configuration may, when the lower insert 68 is positioned against the first adjacent surface, provide a first opening at the base of the lower insert 68 that may allow ink from the inlet 72 of the filter housing 56 to enter into the input restrictor 52. The ink may then flow in an upwardly-winding direction around at least a portion of the lower insert 68 until it reaches a second opening at the top of the lower insert 58, through which the ink may then exit the input restrictor 52. In such an embodiment, the contoured outer side portion 78 may be configured so that, when abutted against an adjacent surface, the ink flow path in the formed input restrictor 52 has a diameter or opening of about 1/32 inch.

As shown in FIG. 7, once through the input restrictor 52, the ink may pass onto a filter medium 62. The filter medium 62 may be constructed from materials suitable for the removal of debris or contaminants from the ink, and which may also assist the input and output restrictors 52, 54 in damping ink pressure fluctuations. Suitable materials for the filter medium 62 include, but is not limited to, polypropylene. The lower portion of the filter medium 66 may include a filter base 66, while the upper portion of the filter medium 66 may include a disk 64. Once passing through the filter medium 66, the ink may proceed on towards the output restrictor 54.

Figure 9:
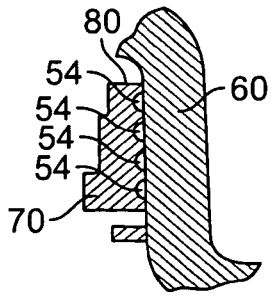
FIG. 9 illustrates a cross sectional view of a molded output restrictor according to an embodiment of the present invention.

FIG. 9 illustrates a cross sectional view of a molded output restrictor 54 according to an embodiment of the present invention. The output restrictor 54 may be molded into the upper insert 70. The output restrictor 54 may also be formed by the placement of ribs, ridges, or grooved openings along the contoured exterior side 80 of the upper insert 70 against a second adjacent surface, such as the inner walls of the upper portion 60. By abutting the grooved contoured exterior side 80 against the second adjacent surface, an output restrictor 54 may be formed that provides a narrow conduit through which ink may flow from the filter medium 62 and towards the outlet 74 of the filter housing 56 or the passageway 76 of the pressure transducer 22. For example, similar to the grooved outer side portion 78 of the lower insert 68, in the embodiment illustrated in FIG. 9, the contoured exterior side 80 of the upper insert 70 may have a spiral grooved configuration. The spiral grooved configuration may, when the upper insert 70 is positioned against an adjacent surface, provide a proximate opening at the base of the upper insert 70 that may allow ink to enter into the output restrictor 54. The ink may then flow in an upwardly-winding direction around the upper insert 70 until it reaches a distal opening at the top of the upper insert 70 through which the ink may then exit the output restrictor 54. In such an embodiment, the grooves of the contoured exterior side 80 may be configured so that, when abutted against the second adjacent surface, the ink flow path in the formed output restrictor 54 has a diameter or opening of about 1/32 inch. However, as previously stated, the selected size, shape, and configuration of the input and output restrictors 52, 54 may depend on various factors, including, but not limited to, the viscosity of the ink or fluids.

Referring back to FIG. 1, as the ink exits the pressure damping ink filter 16, a pressure transducer 22 may monitor the pressure of the ink that is being supplied to the nozzle 26. Because the ink jet printer 10 may be calibrated to function with a specific preset ink pressure level, the pressure transducer 22 may attempt to maintain or restore the preset level of ink pressure by signaling to the pump 14 to change its speed so as to alter the flow rate of ink exiting the pump 14. For example, the pressure transducer 22 may monitor the pressure level of the ink to ascertain whether the actual pressure level is within 0.25 psi of the preset level, and may communicate any needed changes in ink flow rate to the pump 14. Supplying the nozzle 26 with ink that is within the preset pressure level improves the ability and chances that the selected stream of ink drops passing through the charging tunnel will be fully charged, and therefore, projected towards its intended location on the substrate 36.

After passing by the pressure transducer 22, but before reaching the nozzle 26, the ink stream may reach a valve 24, such as a solenoid valve. Upon activation of the ink jet printer 10, the valve 24 may initially be in a closed position so that the ink stream is unable to pass onto, and through, the nozzle 26 until the pressure of the ink stream reaches a predetermined level. By remaining in a closed position until the ink stream reaches the predetermined pressure level, the valve 24 may prohibit under-pressurized ink from being projected from the nozzle 26 with insufficient force to reach the substrate 36, and thereby may prevent under-pressurized ink from being deposited in the charging tunnel 25 and/or the first and second deflection electrodes 30, 32. Once the ink stream reaches a predetermined pressure level, for example 20 psi for some types of ink, the valve 24 may open. The ink stream may then pass through the nozzle 26, where the ink may be projected with sufficient force so as to reach a catcher 34. During this period, the charging field 28 and/or the first and second deflection electrodes 30, 32 may not be activated so as to not interfere with the path of the projected ink to the catcher 34. The catcher 34 may then re-circulate at least a portion of the captured ink back to the ink system 12, where the ink may be re-used. Once the pressure of the ink stream between the pump 14 and nozzle 26 is within operating ranges, the ink may be projected out of the nozzle 26 with sufficient force, and through the activated charging field 28 and first and second deflection electrodes 30, 32, so that the ink may be deposited at its intended location on the substrate 36. For example, for some types of ink, once the ink pressure level is between 30-40 psi, the ink may be projected from the nozzle 26.

Ink may be emitted from the nozzle 26 as a stream of regularly sized and spaced droplets 40. The stream of droplets 40 may then pass through a charging tunnel 28, where each droplet may receive a different electrical charge. The degree of charge a droplet 40 receives may determine its ultimate position/location on the substrate 36.

The charged droplets 40 may then pass between a high voltage deflection electrode 30 and a low voltage deflection electrode 32. As the charged droplets 40 pass between the high and low voltage deflection electrodes 30, 32, the amount of charge applied to a droplet 40 in the charging tunnel 28 determines the degree the charged droplet 40 will deflect towards the substrate 36. Deflected droplets 42 may be projected with a trajectory that allows the deflected droplets 42 to strike the substrate at the desired position/location. Uncharged or slightly charged droplets may pass substantially undeflected to the catcher 34, and subsequently may be recycled back to the ink system 12 for reuse.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A system configured for damping pressure fluctuations in an ink stream within an ink jet printer comprising:

a filter medium;

a filter housing having an inlet, an outlet, at least one interior wall, and an inner portion, said filter medium being positioned within said inner portion; and at least one flow control member operably connected to said filter housing, said at least one flow control member configured to restrict the flow of said ink stream, and said at least one flow control member also configured to assist in reducing pressure fluctuations in the ink stream, wherein said at least one flow control member comprises a fixed input restrictor and a fixed output restrictor.

2. The system of claim 1, wherein said fixed input restrictor and said fixed output restrictor are both located in said inner portion of said filter housing.

3. The system of claim 1, wherein said fixed input restrictor is located outside said filter housing, said fixed input restrictor being operably connected to said inlet, said fixed output restrictor being located in said inner portion of said filter housing.

4. The system of claim 1, wherein said fixed input restrictor and said fixed output restrictor are both located outside said filter housing, said fixed input restrictor being operably connected to said inlet, said fixed output restrictor being operably connected to said outlet of said filter housing.

5. The system of claim 1, wherein said fixed input restrictor is located inside said inner portion of said filter housing, said fixed output restrictor being located outside filter housing, said fixed output restrictor being operably connected to said outlet of said filter housing.

6. A system configured for damping pressure fluctuations in an ink stream within an ink jet printer comprising:

a filter medium;

a filter housing having an inlet, an outlet, at least one interior wall, and an inner portion, said filter medium being positioned within said inner portion; and a lower insert having a contoured outer side portion, at least a portion of said contoured outer side portion abutting against a first adjacent wall within said inner portion forming an input restrictor there-between, said input restrictor configured to restrict flow of the ink stream as the ink stream flows from said inlet of said filter housing toward said filter medium.

7. The system of claim 6 further comprising an upper insert having a contoured exterior side, at least a portion of said contoured exterior side abutting against a second adjacent wall within said inner portion forming an output restrictor there-between, said output restrictor configured to restrict flow of the ink stream as the ink stream flows from said filter medium to said outlet of said filter housing.

8. The system of claim 6 further comprising an output restrictor positioned outside said filter housing, said output restrictor operably connected to said outlet of said filter housing.

9. The system of claim 6 wherein said contoured outer side portion comprises a spiral groove, the abutment of said contoured outer side portion against said first adjacent wall forming said input restrictor along said spiral groove, said spiral groove having a first opening and a second opening, said first opening positioned to allow said ink stream to enter into said input restrictor, said second opening positioned to allow said ink stream to exit out of said input restrictor.

10. The system of claim 6 wherein said first adjacent wall comprises a filter base.

11. The system of claim 6 wherein said first adjacent wall comprises at least a portion of said at least one interior wall of said filter housing.

12. The system of claim 6 wherein said filter housing comprises an upper portion and a lower portion.

13. A system configured for damping pressure fluctuations in an ink stream within an ink jet printer comprising:

a filter medium;

a filter housing having an inlet, an outlet, at least one interior wall, and an inner portion, said filter medium being positioned within said inner portion; and an upper insert having a contoured exterior side, at least a portion of said contoured exterior side abutting against a second adjacent wall within said inner portion forming an output restrictor there-between, said output restrictor configured to restrict flow of the ink stream as the ink stream flows from said filter medium to said outlet of said filter housing.

14. The system of claim 13 further comprising a lower insert having a contoured outer side portion, at least a portion of said contoured outer side portion abutting against a first adjacent wall within said inner portion forming an input restrictor there-between.

15. The system of claim 13 further comprising an input restrictor positioned outside said filter housing, said input restrictor operably connected to said inlet of said filter housing.

16. The system of claim 13 wherein said contoured exterior side comprises a spiral groove, the abutment of said contoured exterior side against said second adjacent wall forming said output restrictor along said spiral groove, said spiral groove having a proximate opening and a distal opening, said proximate opening positioned to allow said ink stream to enter into said output restrictor, said distal opening positioned to allow said ink stream to exit out of said output restrictor.

17. The system of claim 13 wherein said second adjacent wall comprises at least a portion of an interior wall of said filter housing.

18. The system of claim 13 wherein said filter housing comprises an upper portion and a lower portion.

19. The system of claim 18 wherein said second adjacent wall comprises at least a portion of said upper portion of said filter housing.

* * * * *